United States Patent [19]

Eisenberg

[11] 3,990,209

[45] Nov. 9, 1976

[54] MACHINE AND METHOD FOR TRANSFERRING PREDETERMINED NUMBERS OF ITEMS

[75] Inventor: Bernard C. Eisenberg, Rockaway, N.J.

[73] Assignee: Solbern Corporation, Fairfield, N.J.

[22] Filed: June 19, 1975

[21] Appl. No.: 588,205

Related U.S. Application Data

[63] Continuation of Ser. No. 423,123, Dec. 10, 1973, abandoned.

[52] U.S. Cl. ..... 53/26; 53/35; 53/160; 53/164

[51] Int. Cl.[2] ..... B65B 35/32; B65B 35/34; B65B 35/52

[58] Field of Search ..... 53/26, 35, 160, 166, 53/158, 164, 147, 126, 247, 261, 263; 141/12, 45, 135, 133, 165, 131; 222/302

[56] References Cited

UNITED STATES PATENTS

| | | | |
|---|---|---|---|
| 1,893,831 | 1/1933 | Weber | 141/133 |
| 2,055,075 | 9/1936 | Gardner | 141/133 |
| 2,363,014 | 11/1944 | Nicolle | 53/166 |
| 2,815,622 | 12/1957 | Barrett | 53/26 X |
| 3,028,713 | 4/1962 | Kennedy et al. | 53/247 X |
| 3,298,404 | 1/1967 | Eisenberg | 53/35 UX |
| 3,488,915 | 1/1970 | Delestatius | 53/126 X |
| 3,505,777 | 4/1970 | Tsutsumi | 53/247 X |
| 3,621,891 | 11/1971 | Eisenberg | 141/165 X |

*Primary Examiner*—Travis S. McGehee
*Assistant Examiner*—Horace M. Culver
*Attorney, Agent, or Firm*—Kenyon & Kenyon Reilly Carr & Chapin

[57] ABSTRACT

A transfer type of product filling machine includes means for delivering items of substantially uniform size to an intermediate receptacle for subsequent transfer to an ultimate container. The intermediate receptacle is subdivided into separate product receiving volumes, each receiving volume being sized to hold a predetermined small number of the items. The total capacity of the receptacle is exactly equal to the number of items to be delivered to the ultimate container.

12 Claims, 10 Drawing Figures

Fig. 5A.
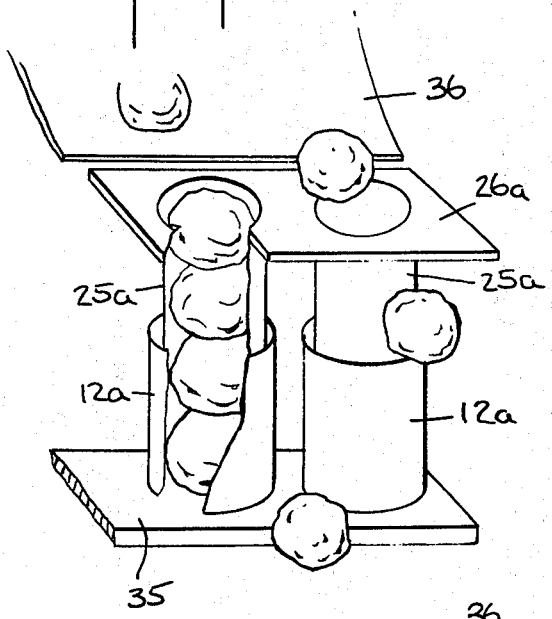
Fig. 5B.
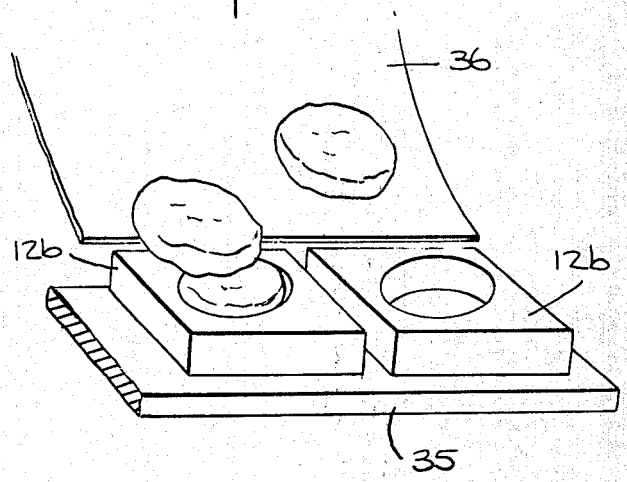
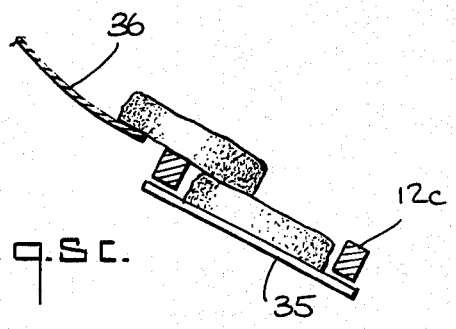
Fig. 5C.
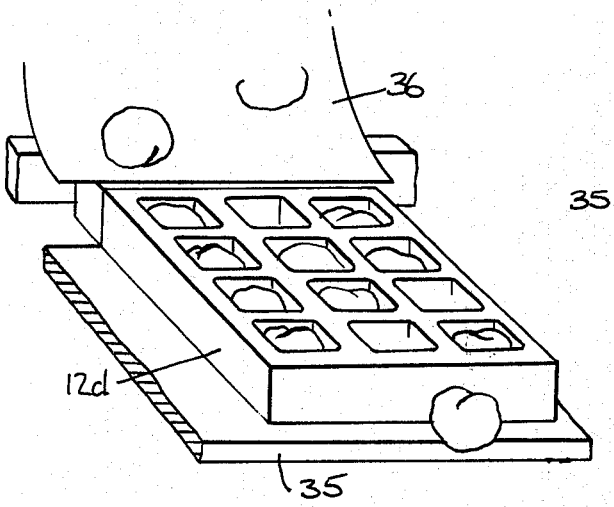
Fig. 5D.
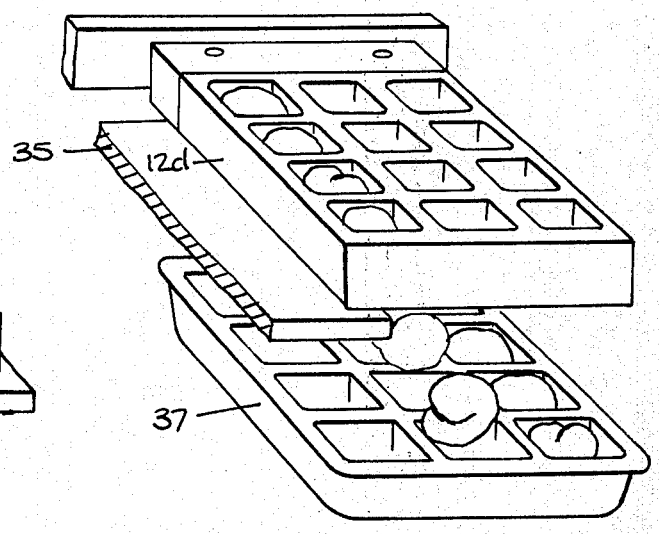
Fig. 5E.

MACHINE AND METHOD FOR TRANSFERRING PREDETERMINED NUMBERS OF ITEMS

This is a continuation of application Ser. No. 423,123, filed Dec. 10, 1973, and subsequently abandoned.

BACKGROUND OF THE INVENTION

1. Field of the Invention

This invention relates to product filling machinery and particularly to machines and methods for filling an intermediate receptacle with a predetermined amount of product for transfer to an ultimate container.

2. Description of the Prior Art

My U.S. Pat. Nos. 3,517,708, issued June 30, 1970; No. 3,621,891, issued Nov. 23, 1971; and No. 3,696,581, issued Oct. 10, 1972 describe rotary-drum machines for filling intermediate receptacles with predetermined amounts of materials for transfer to ultimate containers, and their disclosures are incorporated herein by reference.

In these prior machines, elongated rake members spaced circumferentially around a horizontal or inclined drum mounted for rotation about its axis each have a plurality of inward-projecting tines for picking up portions of materials such as food products in the bottom of the drum as the drum rotates and for carrying the portions to a predetermined release point near the top of the drum for discharge onto a chute or shaker tray for delivery into a line of intermediate receptacles extending through the drum. The receptacles are fastened to an endless conveyor that includes means for shaking the receptacles as they are filled to eliminate voids and to obtain a uniform packing density in each receptacle corresponding to a predetermined package amount. After being filled, the intermediate receptacles are transported by the conveyor to a separate station outside the drum where their contents are transferred to a line of ultimate containers on a second conveyor that is synchronized with the movement of the receptacle conveyor.

One method shown in these prior patents (U.S. Pat. No. 3,517,708) for transferring products from the intermediate receptacles to the ultimate containers includes pivoting each receptacle on an arm for 180° rotation outward around the line of the conveyor to an upended position over the container to which the product is to be transferred. A close-fitting cylindrical shell located on the arc of receptacle rotation prevents the loss of any material until each receptacle is fully upended and has advanced to a position directly over the corresponding container.

An alternate method shown in U.S. Pat. No. 3,621,891 and 3,696,581 for transferring products involves the use of automatically controlled doors mounted directly under an open-bottom receptacle, the doors being rotatable in synchronism from a horizontal position where they close the bottom of the receptacle to a vertical position over the container line where they funnel the product into the underlying container.

The above-described product transfer methods of my prior inventions require relatively complex mechanical arrangements for synchronizing the receptacle rotating or door opening mechanisms, as well as a large number of parts that add to the cost and difficulty of cleaning these prior machines. In addition, the intermediate receptacles used in these machines comprise a single open volume, exactly sized to accommodate a predetermined weight of uniformly packed products. For packing stringy or tangly products, they may include various cutters and soft rollers for trimming excess materials hanging over the edges of the containers and for compressing materials to a uniform packing density at a height even with the top edges of the receptacles.

In many filling applications, instead of filling to a predetermined weight or packed volume of materials it is desired to fill a predetermined number of items into a container, the items having a relatively uniform size. Examples in the packaging of food include such items as meatballs, crab cakes, croquettes, egg rolls, doughnuts, graded size fruits, and the like. In such applications it is quite difficult to fill accurately and repeatably a single open receptacle with the exact number of items desired in each ultimate container because an individual item may take only a small percentage of the total receptacle volume and the shape of the receptacle volume does not conform to the shape of the items so that extra items may squeeze into corners of the receptacle. Also, in many packaging applications it is desirable to place items in desired relative positions in a container as, for example, apples, peaches or oranges in columns and rows on a flat tray or in a partitioned box. Such predetermined placement cannot be obtained reliably by merely filling a single-volume transfer receptacle with the desired number of items to be packaged in each container.

SUMMARY OF THE INVENTION

It is an object of the present invention to provide a method and apparatus for filling containers with a predetermined number of items.

Another object of the invention is to measure a predetermined number of items into an intermediate receptacle from a source of such items at a first filling location and subsequently to transfer the items to a container at a second station that is displaced from the first station.

Another object of the invention is to provide subdivided intermediate receptacles for a transfer filling machine, the subdivisions forming compartments shaped to fit the items and each compartment sized to accommodate only a predetermined small number of the items.

It is another object of the invention to provide easily replaceable intermediate receptacles for a transfer filling machine to permit filling different numbers, sizes and shapes of items by means of different intermediate receptacles.

Another object of the invention is to provide a locking pin attachment for replaceable receptacles of a transfer filling machine to permit easy replacement of receptacles without the need for tools.

It is another object of the invention to provide an arrangement of intermediate receptacles and an associated conveyor for a transfer-type filling machine of simplified construction for low cost and ease of maintenance and cleaning.

These and other objects are achieved in a machine that includes an endless conveyor for transporting intermediate receptacles from a first location for filling the receptacles from a source of items with a predetermined number of the items to a second location for transferring the predetermined number of items from each receptacle to a corresponding container.

Each receptacle is subdivided into bottomless pockets that are shaped and sized to fit the items being transferred, the depth of each pocket being sufficient to accommodate exactly a predetermined small number of the items and the number of pockets in each receptacle being chosen so that each receptacle will hold the total predetermined number of items to be packaged in the corresponding container.

The receptacle conveyor is preferably a link type conveyor, the links being trained about wheels that rotate about vertical axes and the link line travelling in a substantially horizontal plane.

A base plate is positioned under the receptacles and extends from the filling location to just short of the transfer location. The receptacles have flat bottoms that rest on and slide over the base plate in the path between the filling location and the transfer location, the base plate thereby serving to close the bottoms of the receptacle pockets between the filling and transfer locations.

The source of items for filling the receptacles at the filling location preferably includes an open-ended drum mounted for rotation about either a horizontal or an inclined axis. The items are delivered to the bottom of the drum, preferably by means of a chute through one of its open ends, and shelf members circumferentially spaced around the inside of the drum carry items from the bottom of the drum to a discharge point near the top of the drum as it rotates. At the discharge point, the items are released, preferably to a chute or shaker tray from which they are delivered to the receptacles.

Preferably, means are provided for shaking the receptacles at the filling location to assist in placing the predetermined number of items in proper orientation in each pocket and to shake off any excess items from the tops of the receptacles, the excess items then falling to the bottom of the drum of recycling.

The receptacles preferably comprise a base member and an extension member, the base member having a number of pockets of sufficient depth to accommodate the total predetermined number of items for the smallest size container to be filled. The extension member includes thin-shell cylindrical inserts for a tight sliding fit within each pocket of the base member, the height of the inserts above the base plate being adjustable to accommodate additional items for filling a complete range of container sizes. For ease of cleaning in food packaging applications the extension members may be fabricated from stainless steel and the base member from nylon, which also provides a low friction, non wearing surface in contact with the base plate.

To permit rapid changeover from one size or arrangement of receptacles to another, the invention features a quick-disconnect receptacle attachment system preferably in the form of two spaced upright pins, one at each of a conveyor link for mating engagement with two holes near one edge of each receptacle base member. Receptacles are easily replaced by simply lifting one receptacle off the pins and substituting another. Preferably one of the pins includes a plunger-actuated detent for locking the receptacle in place against the vibrational environment of the machine.

In operation, each intermediate receptacle attached to the transfer conveyor slides over the base plate and passes in turn under a product delivering means, such as the aforementioned rotary drum and chute or shaker tray. Items cascade from the chute over the top of the receptacle and fall into the individual pockets of the receptacle, which is simultaneously shaken to aid the filling process and help orient the items in the pockets. The shaking continues for a short distance after the receptacle leaves the filling location to dislodge any extra items remaining on the top of the receptacle.

The conveyor then transports the receptacle, still sliding along the base plate so that no items are lost from its open bottom, to a transfer location outside the drum. The transfer location is situated immediately above open containers on a second conveyor that is synchronized with the movement of the transfer conveyor. The base plate terminates at this transfer location, and as the receptacle passes over the end of the plate, the open-bottom pockets are progressively exposed, allowing the items to drop into the container below.

Additional features and advantages of the invention will become apparent from the following description of the preferred embodiment as disclosed in the accompanying drawings.

DESCRIPTION OF THE DRAWINGS

FIG. 5A is a perspective view of the filling location showing in schematic form the combination of an intermediate receptacle base member and extension member arranged to receive exactly a predetermined number of items in each pocket.

FIG. 5B is a perspective view of the filling location showing in schematic form a receptacle base member arranged to receive exactly one item in each pocket.

FIG. 5C is a side view of an alternate arrangement of the receptacle of FIG. 5B.

FIG. 5D is a perspective view of the filling location showing in schematic form a multi-pocket receptacle for receiving exactly one item in each pocket in a predetermined spatial relation.

FIG. 5E is a perspective view at the transfer location of the multi-pocket receptacle of FIG. 5D, showing synchronized transfer of the items to a multi-pocket container.

DESCRIPTION OF THE PREFERRED EMBODIMENT

Figure 1:
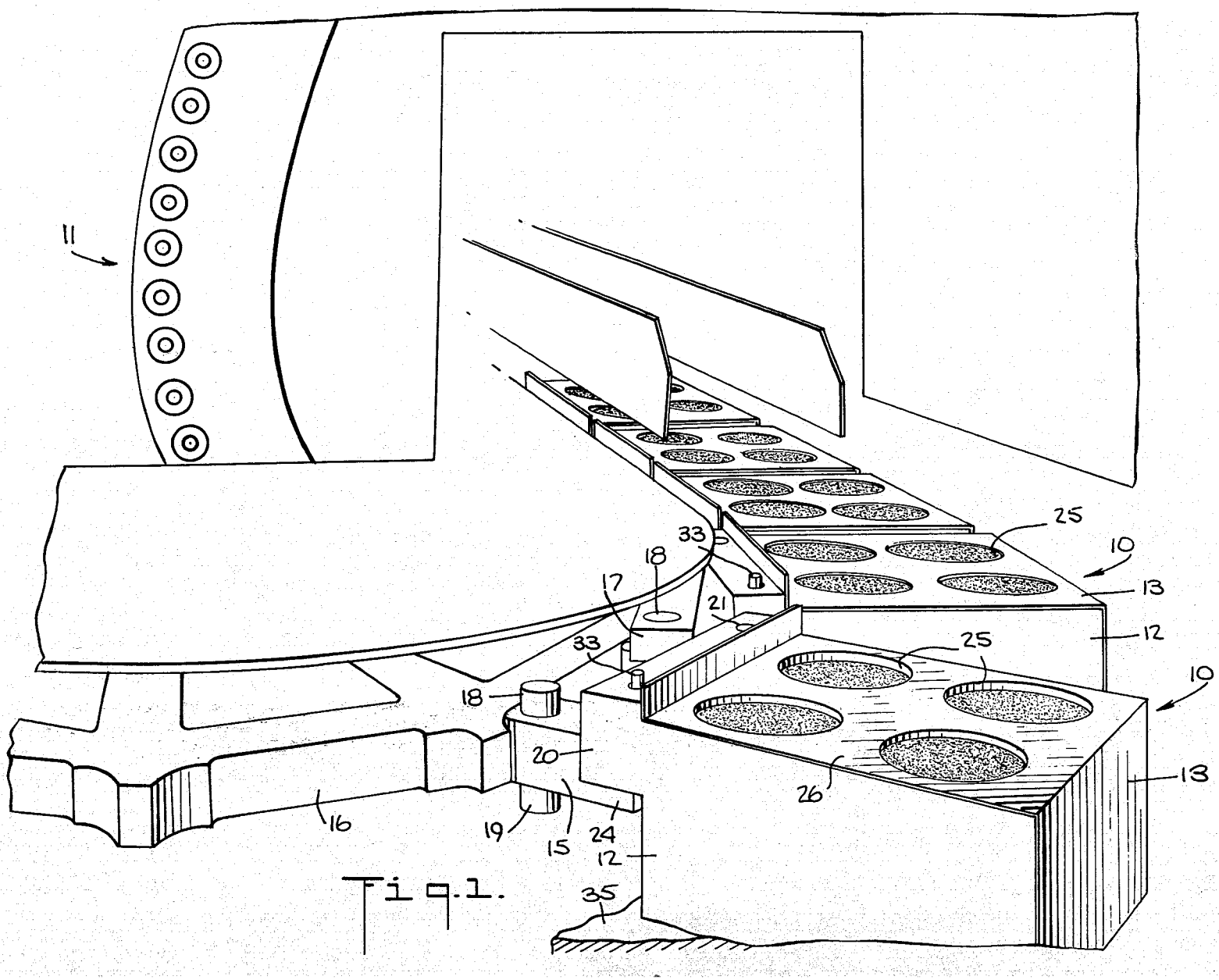
FIG. 1 is a perspective view of the preferred arrangement of transfer conveyor and intermediate receptacles looking toward the exit end of a drum-type machine for filling the receptacles.

Referring to the drawings, FIG. 1 shows a perspective view of filled intermediate receptacles 10 of the invention leaving the exit end of a drum-type filling machine 11 of the type fully described in my prior patents incorporated by reference in the present application.

Each intermediate receptacle includes a base member 12, preferably molded of white nylon, and an optional extenson member 13, preferably fabricated of stainless steel sheet material. Base member 12 is formed with a plurality of vertical-walled pockets 14 extending through the member from top to bottom, each pocket being sized and shaped to accommodate the particular items being transferred. In the illustrative example, the pocket cross sections are circular, a shape suitable for substantially spherical items such as apples, oranges, or meatballs and also for flatter items, either round like doughnuts or square like ravioli, for example. When elongated items like croquettes or egg rolls are being handled, however, it is preferably to have oblong or slot-like pockets of the proper dimensions so that there is not a large amount of extra space for capturing more items in a pocket than are desired.

Receptacle base members 12 are detachably mounted to links 15 of an endless conveyor passing around a large diameter sprocket wheel 16, that rotates about a vertical axis adjacent to the exit end of the filler drum, and around a similar wheel (not shown) adjacent to the entrance end of the drum. The links in the foreground of FIG. 1 have been removed to show the construction of sprocket wheel 16.

Adjacent links 15 are joined by intermediate links 17 pivotally mounted at each end on corresponding upper and lower pins 18, 19 on the adjacent ends of corresponding links 15.

Figure 2:
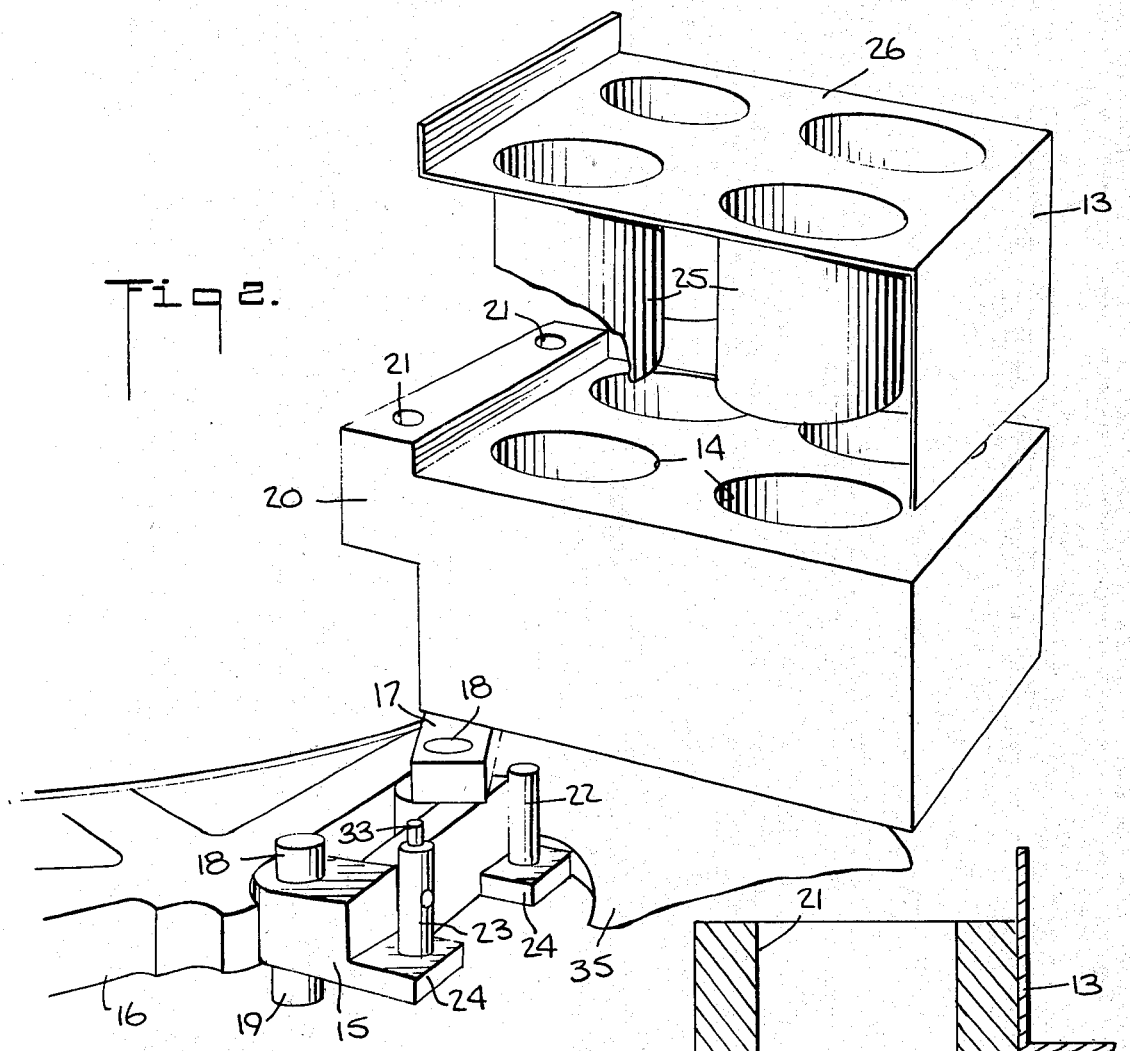
FIG. 2 is an exploded view of an intermediate receptacle, including base member and extension member, and a corresponding conveyor link showing the upright mounting pins.

As shown more clearly in FIG. 2, receptacle base members 12 have a flange-like extension 20 in which are formed a pair of mounting holes 21. Mounting holes 21 are sized and spaced to slidingly fit over upright mounting pins 22 and 23 that are affixed to protruding lugs 24 of each conveyor link 15, the receptacles thereby being cantilevered from mounting pins 22, 23, with lugs 24 providing a locating stop in conjunction with the undersurface of extension 20 on the receptacle base member.

FIG. 2 also shows the construction of receptacle extension member 13, which comprises a plurality of sheet metal cylinders 25 equal in number to pockets 14 in the base member and joined to a sheet metal top 26 in properly spaced relation to coincide with the spacing of pockets 14. In the embodiment shown in FIG. 2, cylinders 25 have a circular cross section, with their outside diameters chosen to provide a tight sliding fit within the pockets of the base member so that the extension member can be telescoped up or down with respect to the base member for accommodating a range of integral numbers of items in each pocket depending on the total number of items desired to be transferred by each intermediate receptacle.

Alternatively, different extension members with cylindrical portions of graduated length corresponding to integral increments in items per pocket can be substituted in a base member of height corresponding to one item per pocket to provide any desired total number of items in multiples of the number of pockets per base member. Furthermore, total numbers intermediate these multiples can be easily obtained by covering one or more of the pockets with a removable lid (not shown).

Figure 3:
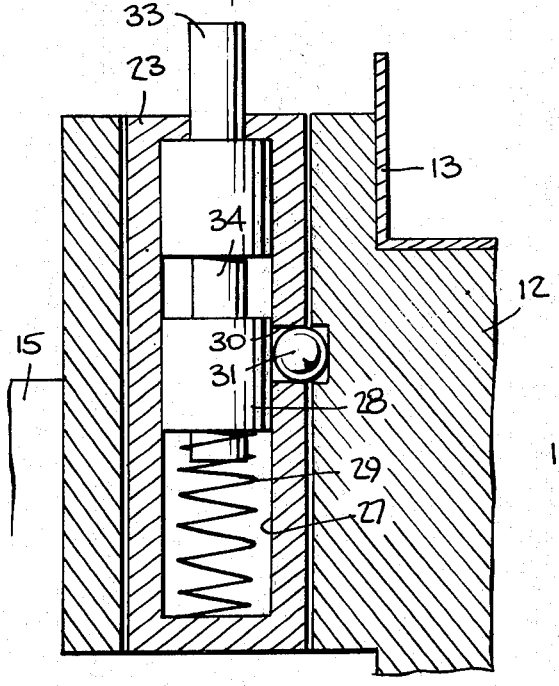
FIG. 3 is a section view of a locking detent arrangement for one of the mounting pins shown in FIG. 2, with the receptacle locked in place.
Figure 4:
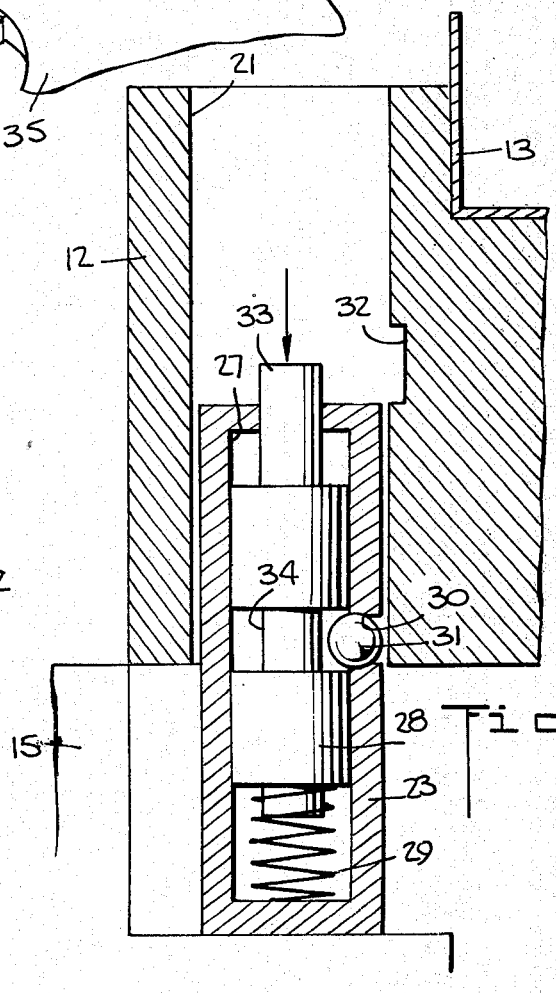
FIG. 4 is a section view of the locking detent arrangement of FIG. 3 with the detent unlocked to allow removal of the receptacle.

With reference to the receptacle mounting arrangement, pin 22 is a plain cylindrical rod, but pin 23 is equipped with means for locking base member 12 to conveyor link 15. As shown in FIGS. 3 and 4, mounting pin 23 has a hollow cylindrical interior portion 27 in which is located a loose-fitting grooved piston member 28 that is biased to an upper position against the upper end of cylinder 27 by a coil spring 29 in the bottom of the cylinder. In this upper position, the full diameter of piston 28 is opposite a hole 30 through the side wall of pin 23.

A stainless steel ball 31 fits loosely in hole 30, the outer edge of which is peened over to prevent the ball from falling out while allowing it to protrude sufficiently to produce a detent locking action in conjunction with a mating indentation 32 in the side wall of the corresponding mounting hole 21.

To unlock the detent, downward force must be applied to the top of a plunger 33, that extends upward from the top of piston 28 through a reduced diameter hole in the top of pin 23, until a groove 34 in piston 28 is aligned with hole 30, thereby allowing ball 31 to retract flush with the surface of pin 23, as shown in FIG. 4. Thus the locking device of the preferred embodiment permits easy and quick mounting and removal of intermediate receptacles on the transfer conveyor without the need for any tools.

As mentioned earlier, when the receptacle base members are slipped onto mounting pins 22, 23, the upper surfaces of lugs 24 act as stops to further downward movement of the receptacle by contacting the lower surfaces of flange-like extensions 20. The height of lugs 24 above a stationary base plate or dead plate 35 that extends under the receptacles in a path from a filling location inside drum 11 to a transfer location outside the drum is adjusted to be equal to the vertical distance between the bottom of each receptacle base member 12 and the undersurface of its flange-like extension 20; so that the receptacles, when locked in place on the mounting pins, will contact dead plate 35 while travelling between the filling location and the transfer location.

FIGS. 5A through 5E depict in schematic fashion various intermediate receptacle arrangements for receiving and transferring predetermined exact numbers of items. In FIG. 5A a two-pocket intermediate receptacle has a base member **12*a* (shown as two separate cylinders for simplicity) that has a capacity for two items in each pocket. An extension member having two cylindrical shells 25*a* and a top plate 26*a*** fits snugly into the pockets of the base member and has been raised to provide an extended capacity of exactly four items in each pocket, as shown.

The items are discharged from the shelves of a rotary drum (not shown) onto an inclined chute 36 which delivers them to the intermediate receptacles. The slope of the chute is adjusted so that the items have just enough momentum to cross top plate **26*a*** of the extension member, in the event they do not fall into one of the pockets, and drop into the bottom of the drum for recycling. The rate of delivery of the items from the rotary drum must be at least enough to assure complete filling of each pocket of every receptacle, but at the same time, excessive delivery rates should be avoided to minimize injury to the items from too much recycling.

In FIG. 5B, flat patty-shaped items are delivered from the inclined chute 36 to intermediate receptacle base members **12*b* having a pocket depth no greater than the thickness of one of the items. Because the flat patties must slide instead of rolling like the more spherical items shown in FIG. 5A, the slope of the chute should be greater to counteract the greater frictional resistance. In addition, it may be desirable to include means for laterally shaking the intermediate receptacles as they pass the filling location to assist the items into the pockets and to shake off excess items from the top of the receptacle. Such shaking means are shown in FIGS. 1 and 3 and described at column 5, lines 34–45** of my U.S. Pat. No. 3,621,891, referred to above.

Alternatively or in addition to the shaking means, the dead plate 35 can be warped to an angle at the filling location, as shown in FIG. 5C, and the links of the conveyor (not shown) twisted accordingly so that the top of the receptacle serves as an extension of the slope at the end of chute 36, thereby allowing excess items to slide across the receptacle and fall back into the bottom of the drum.

FIGS. 5D and 5E illustrate the use of the intermediate receptacle of the present invention for transferring an exact number of items in a predetermined spatial relation for filling a compartmented container. In FIG. 5D, an open bottom intermediate receptacle **12*d* is partitioned into a number of pockets arranged in rows and columns, each pocket being just deep enough to hold one of the items shown. The intermediate receptacle is filled with the predetermined exact number of items, in this case one dozen, at the filling location shown in FIG. 5D and is then conveyed, in sliding contact with dead plate 35, to the transfer location, as shown in FIG. 5E**.

Dead plate 35 terminates at the transfer location, thereby allowing each column of items to drop in turn through the open bottoms of the receptacle pockets into corresponding compartments of a container 37 that is moved in synchronism with the movement of the intermediate receptacle **12*d*** by means of a second conveyor (not shown).

Figure 6:
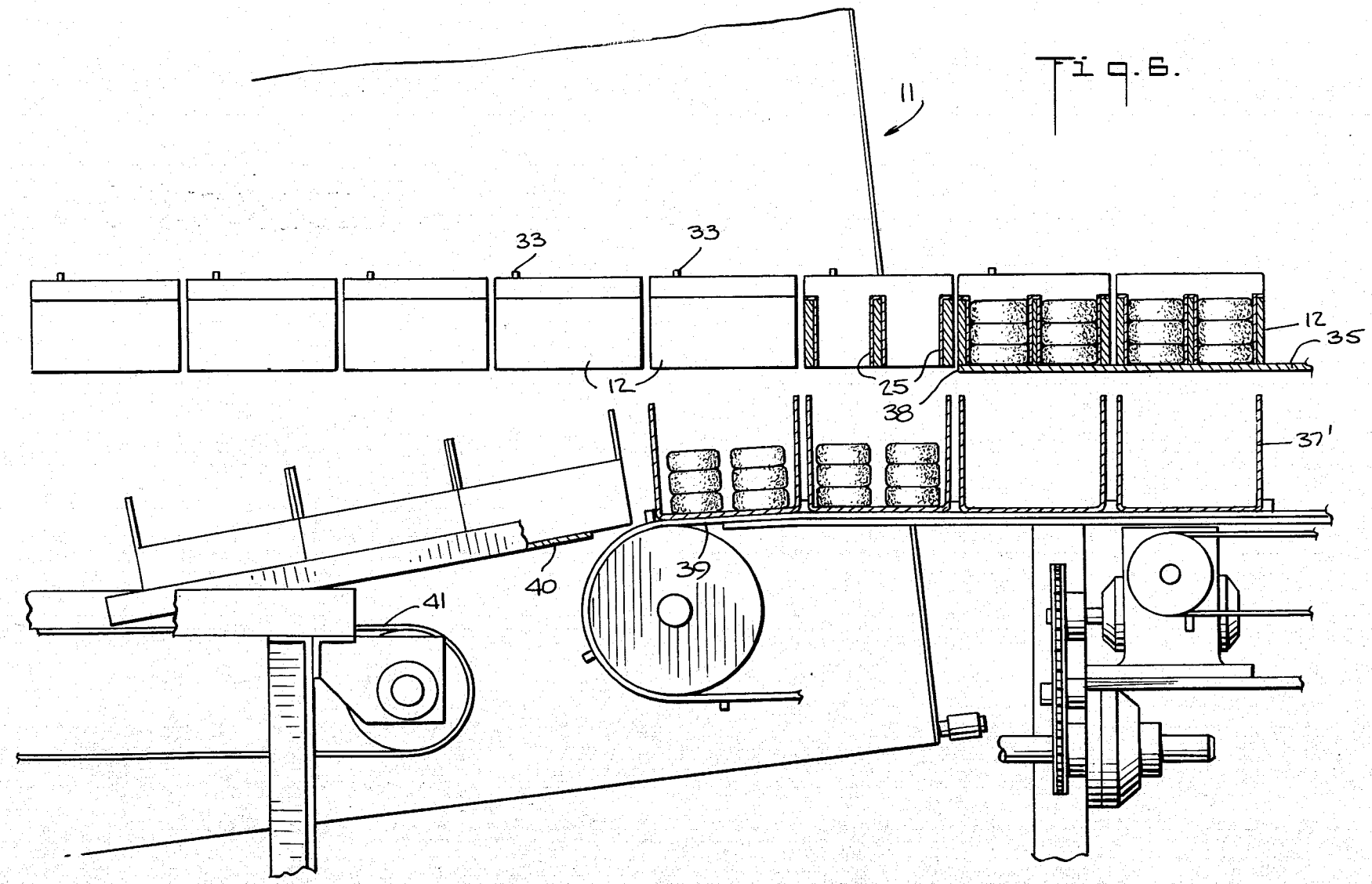
FIG. 6 is a side view of the transfer location showing the spatial relation between the transfer conveyor and the second conveyor carrying containers to be filled.

The transfer location is shown in more detail in FIG. 6. Filled intermediate receptacles, which have been conveyed over dead plate 35 past the filling location inside drum 11 then out the exit end of the drum and around sprocket wheel 16 (FIG. 1), travel back (to the left) along the outside of the drum. The transfer location occurs at the end 38 of base plate 35. Just underneath this terminal point pass a second line of containers 37' on a conveyor belt 39, which is synchronized in its movement with the movement of the intermediate receptacle conveyor so that containers 39 arrive at the transfer location simultaneously and in synchronism with the arrival of intermediate receptacles 12.

As the intermediate receptacles pass over end 38 of dead plate 35, the open bottoms of the pockets are uncovered, allowing the items to drop into the container below, which then moves off conveyor 39 to a slide 40 and a third conveyor 41 to a closing and sealing station (not shown).

From the foregoing description it can be seen that the improved transfer apparatus of the present invention permits accurate count filling of a variety of shapes and sizes of containers by means of easily and rapidly exchanged intermediate receptacles; so that one rotary-drum filling machine can be adapted to count fill an almost endless variety of containers with a wide variety of size graded products.

In addition, the pin-detent receptacle mounting means described as a feature of the present invention permits use of the transfer filling machine for weight or volume filling of intermediate receptacles in a manner shown in my prior U.S. patents made of reference herein. At the same time, the simple dead plate arrangement described herein reduces the cost of construction and maintenance of the filling machine and greatly simplifies the task of cleaning, which is such an important concern with food handling machinery.

What is claimed is:

1. A method for transferring a predetermined number of items from a filling station to each of a plurality of containers at a discharge station, the method comprising the steps of:

conveying a line of intermediate receptacles past the filling station to the discharge station, each receptacle having at least one open-bottomed pocket, the cross-sectional dimensions and depth of said pocket accommodating exactly a preselected fraction of the predetermined number of items to be transferred to each container stacked directly on top of each other, the preselected fraction being equal to the reciprocal of a preselected integer;

placing the bottom of each receptacle in sliding contact with a stationary dead plate that extends from the start of the filling station along the path of the receptacles and terminates at the discharge station;

delivering a reserve supply of the items to the bottom of a rotating drum that surrounds the filling station with its axis extending generally in the path of movement of the receptacles past the filling station;

raising the items as the drum rotates to a location above the filling station;

delivering the items by gravity from the drum at said location along a broad inclined path transverse to a substantially straight line of the receptacles at the filling location, the items being distributed approximately uniformly across the width of the path and being delivered at a rate sufficient to assure filling all the pockets of the receptacles as they pass the filling station;

removing from the tops of the receptacles any items in excess of the predetermined number of items required to fill the pockets;

conveying the filled intermediate receptacles to the discharge station;

conveying a plurality of open containers in synchronism with the movement of the intermediate receptacles to a location at the discharge station relative to the intermediate receptacles for receiving the items;

moving each receptacle in sequence past the end of the dead plate; and discharging the predetermined number of items from a number of the intermediate receptacles equal to said preselected integer into each of the plurality of containers.

2. The method of claim 1 wherein the step of removing from the tops of the receptacles any items in excess of the predetermined number of items required to fill the pockets comprises the step of shaking the receptacles as they are conveyed past the filling station to the discharge station.

3. The method of claim 1 wherein the step of removing from the tops of the receptacles any items in excess of the predetermined number of items required to fill the pockets comprises the step of tilting the receptacles as they are conveyed past the filling station to the discharge station.

4. A machine for transferring a predetermined number of items of substantially uniform size from a filling station to each of a plurality of containers at a discharge station comprising:

a plurality of intermediate receptacles for receiving the items to be transferred, each receptacle having at least one open-bottomed, vertically-sided pocket, the cross-sectional dimensions and the depth of each pocket being selected to accommodate exactly a preselected small number of the items stacked directly on top of each other, said small number being equal to a reciprocal preselected integer fraction of the predetermined number of items to be transferred to each container;

an endless conveyor arranged for travelling in a continuous circuit from the filling station to the discharge station;

means for fastening the plurality of receptacles to the conveyor for transport in a line along the continuous circuit;

an inclined chute having a substantially straight lower edge extending alongside the path of the receptacles at the filling station adjacent the pockets in the receptacles;

an open-ended drum surrounding the filling station with the axis of the drum extending generally in the direction of the path of movement of the receptacles past the filling station;

means supporting the drum for rotation about its axis;

means for delivering a reserve supply of the items to the bottom of the drum;

means spaced circumferentially around the interior of the drum for raising portions of the items in the bottom of the drum and for delivering them to the chute as the drum rotates;

means for rotating the drum at a speed sufficient to deliver items to the chute at a rate that assures filling the pockets of the receptacles as they pass the filling station;

means for laterally shaking the receptacles during at least the latter portion of their travel past the filling station to assist in placing the exact small number of items in each pocket and to shake off any excess items from the tops of the receptacles;

a stationary dead plate positioned for sliding contact with the bottoms of the receptacles through the portion of the conveyor circuit from the start of the filling station to the discharge station, the dead plate terminating at the discharge station for allowing the transferred items to drop through the open bottoms of the receptacle pockets; and means synchronized with the movement of the receptacles past the discharge station for positioning each one of the plurality of containers for receiving the total predetermined number of items discharged from a number of the pockets in said receptacles equal to said preselected integer.

5. The machine of claim 4 wherein each transfer receptacle is subdivided into a number of congruent pockets equal to said predetermined integer, and the means for positioning the containers is synchronized to move the containers in a line passing directly under the line of receptacles at the termination of the dead plate.

6. The machine of claim 4 further comprising means for tilting the receptacles at the end of the filling station to an angle sufficient to cause any excess number of items to slide off the tops of the receptacles without losing any items from the pockets.

7. The machine of claim 4 wherein the means for fastening the plurality of receptacles to the conveyor for transport along the continuous circuit comprises:

a plurality of upright pins spaced along the length of the endless conveyor, at least one pin for each receptacle, the receptacles having mating holes for mounting each receptacle on a corresponding at least one pin.

8. The machine of claim 7 wherein one of the pins for mounting each receptacle includes a plunger-actuated detent mechanism for releasably locking each receptacle to the conveyor.

9. The machine of claim 4 wherein each of the plurality of receptacles comprises a base member made of wear resistant, low friction plastic material, the at least one pocket of the receptacle extending through the bottom of the base member, and the height of the base member corresponding to a pocket depth for accommodating exactly a predetermined number of the items.

10. The machine of claim 9 wherein the base member is made of nylon.

11. The machine of claim 9 wherein each of the plurality of receptacles further comprises an extension member having a number of vertical tubular elements equal to the number of pockets in the receptacle base member, the tubular elements being spaced and sized for telescoping engagement with the pockets in the base member, and the length of the tubular elements corresponding to a pocket depth for accommodating exactly a predetermined integral number of additional items.

12. The machine of claim 4 wherein each of the plurality of receptacles includes at least two pockets arranged in predetermined spaced relation, the arrangement of the pockets providing placement of the items filling said pockets into a container at the discharge station in the same predetermined spaced relation.

* * * * *

UNITED STATES PATENT AND TRADEMARK OFFICE

CERTIFICATE OF CORRECTION

PATENT NO. : 3,990,209

DATED : November 9, 1976

INVENTOR(S) : Bernard C. Eisenberg

It is certified that error appears in the above-identified patent and that said Letters Patent are hereby corrected as shown below:

Column 3, line 37, delete "drum of recycling" and insert --drum for recycling--.

Column 4, line 68, delete "extenson" and insert --extension--.

Column 5, line 11, delete "preferably" insert --preferable--.

Signed and Sealed this

First Day of February 1977

[SEAL]

*Attest:*

RUTH C. MASON
*Attesting Officer*

C. MARSHALL DANN
*Commissioner of Patents and Trademarks*